US007046816B2

(12) United States Patent
Vandersteen

(10) Patent No.: US 7,046,816 B2
(45) Date of Patent: May 16, 2006

(54) COINCIDENT SOURCE STEREO SPEAKER

(76) Inventor: Richard J. Vandersteen, 116 W. Fourth St., Hanford, CA (US) 93230

( * ) Notice: Subject to any disclaimer, the term of this patent is extended or adjusted under 35 U.S.C. 154(b) by 251 days.

(21) Appl. No.: 10/062,828

(22) Filed: Jan. 31, 2002

(65) Prior Publication Data

US 2003/0053644 A1 Mar. 20, 2003

Related U.S. Application Data

(60) Provisional application No. 60/322,807, filed on Sep. 14, 2001.

(51) Int. Cl.
*H04R 25/00* (2006.01)

(52) U.S. Cl. ..... 381/182; 381/351; 381/352

(58) Field of Classification Search ..... 381/182, 381/345, 351, 352, 160, 337–342; 181/144–147, 181/152, 159
See application file for complete search history.

(56) References Cited

U.S. PATENT DOCUMENTS 2,053,364 A * 9/1936 Engholm ..... 381/184
4,437,540 A * 3/1984 Murakami et al. ..... 181/152
4,811,406 A * 3/1989 Kawachi ..... 381/186
5,193,119 A * 3/1993 Tontini et al. ..... 381/182
5,526,456 A * 6/1996 Heinz ..... 381/340
6,038,326 A * 3/2000 Czerwinski ..... 381/340
6,118,883 A * 9/2000 Rocha ..... 381/387
6,222,929 B1 * 4/2001 Kim ..... 381/182
6,282,297 B1 * 8/2001 Lin ..... 381/386
6,343,134 B1 * 1/2002 Czerwinski ..... 381/342
6,411,718 B1 * 6/2002 Danley et al. ..... 381/342

* cited by examiner

*Primary Examiner*—Suhan Ni
(74) *Attorney, Agent, or Firm*—Nordman Cormany et al.; Kenneth J. Hovet

(57) ABSTRACT

A coincident source stereo speaker in accordance with the present invention includes a high-frequency component (tweeter) and a low-frequency component (woofer) that are separated by a sound channel. The tweeter emits a first sound pattern directly outward from the speaker, with the sound pattern having a corresponding high frequency center axis. The sound channel is located between the tweeter and woofer and is symmetrically oriented around the high-frequency component. The woofer emits a second sound pattern into the sound channel for re-direction out of the speaker. With this configuration, the second sound pattern has an effective low frequency center axis that is coincident with the high frequency center axis. As a result, the tweeter and woofer exhibit co-axial performance characteristics, even though they are not physically located co-axially.

8 Claims, 4 Drawing Sheets

COINCIDENT SOURCE STEREO SPEAKER

This application claims priority from Provisional Application Ser. No. 60/322,807, which was filed Sep. 14, 2001.

FIELD OF THE INVENTION

The present invention applies to loudspeakers. More particularly, the present invention applies to loudspeakers that are used in stereo systems. The present invention is particularly, but not exclusively, useful as a high performance speaker which has a uniform output over the entire audible frequency spectrum, even when the listener is not centered in front of the speaker, for increased listening enjoyment.

BACKGROUND OF THE INVENTION

Speakers are well-known in the prior art for providing the user with listening enjoyment of music. In particular, high-performance speakers cooperate with stereo systems to provide extreme clarity of various bass, mid-range and treble music components of the audible frequency spectrum. To do this, a high-performance speaker typically incorporates a woofer component, mid-range component and a tweeter component to provide the respective low frequency, mid-range frequency and high frequency components of a sound pattern.

Most high performance stereo systems also include a center channel loudspeaker. Ideally, a center channel loudspeaker has good measurable sonic performance even when the listener is off-axis. Stated differently, an ideal speaker has a uniform output of low frequency, mid-range frequency and high frequency components of the sound pattern for extreme clarity, even when the listener is not positioned directly in front of the center channel speaker.

In a typical prior art speaker, the tweeter and the mid-range components are oriented one above the other so that their respective sound patterns emanate from the center of the loudspeaker face. Alternatively, the tweeter and mid-range components are co-axially oriented so that the center axis of their sound patterns are coincident. In either case, there are typically at least two woofers that are symmetrically arranged around the tweeter and the mid-range component. Further, for all arrangements, the tweeter, mid-range component and woofers are all positioned so that they emit their respective patterns directly outward from the speaker.

When a speaker has one of the above component arrangements, the frequency response of the speaker becomes degraded if the listener is off-axis because the center axes of the low frequency, mid-range frequency and high frequency sound patterns are not coincident. Specifically, the listener tends to get an increased concentration of low frequency response because the listener is no longer positioned symmetrically between the woofer outputs, and the overall signal that is received by the listener becomes distorted by the low-frequency component of the sound pattern.

One solution to the asymmetrical frequency performance is to arrange the woofer and the tweeter co-axially, so that the respective center axes of the low-frequency and high-frequency sound beams are coincident. In this arrangement, however, the woofer becomes limited in power-handling capabilities. To address the power handling problem, another woofer is typically added, but this can sometimes become impractical, particularly when a small-size speaker is desired. What is needed is a speaker wherein the woofers are arranged in such a manner that the center axis of the emitted low-frequency beam is coincident with the center axes of the mid- and high-frequency sound beams emanating from the respective mid-range and tweeter components. If this is achieved, a uniform intensity of sound is heard by the listener over the entire audible spectrum, even if the listener is not centered directly in front of the speaker.

In light of the above, it is an object of the present invention to provide a speaker wherein a uniform response is received by the listener over the entire audible frequency range, even if the listener is not located directly in front of the speaker. It is another object of the present invention to provide a speaker wherein the emanating sound patterns of the woofer are superimposed over the sound patterns of the tweeter and mid-range components, to form a single tri-axial sound pattern from the speaker. Yet another object of the present invention is to provide a speaker wherein the center axis of the emitted low frequency beam is coincident with the center axes of the emitted mid-range frequency and high frequency sound beams. It is another object of the present invention to provide a speaker wherein a low frequency sound duct is arranged and symmetrically oriented around the tweeter and the mid-range components of the speaker. Another object of the present invention is to provide a speaker with a wider listening area which achieves lower distortion and higher power handling capabilities along with a flat global frequency response. Yet another object of the present invention is to design a speaker which is easy to use and is cost effective to manufacture.

SUMMARY OF THE INVENTION

A coincident source speaker in accordance with the present invention includes a high frequency component, or tweeter, that emits a high frequency sound pattern and a low frequency component, or woofer, that emits a low frequency sound pattern. The tweeter emits the high frequency sound pattern directly out of the speaker. The woofer emits the low frequency sound pattern in such a manner so that the effective center axis for the low frequency sound pattern is co-axial with the high frequency sound pattern center axis. This is true even though the tweeter and woofer are not physically co-axially located within the speaker. Optionally, the speaker may include a mid-range component that is either physically co-axial with the tweeter or close enough that the corresponding mid frequency sound pattern has a center axis that is essentially coincident with the high frequency and effective low frequency center axes.

To allow the tweeter and woofer to cooperate as described above, the speaker of the present invention includes a sound channel. The sound channel is located between the woofer and the tweeter and is oriented so that it is geometrically symmetrical with respect to the tweeter, when viewed from the front face of the tweeter (speaker). Preferably, the channel is defined by the rear wall of an enclosure that holds the tweeter and a parallel, spaced-apart support wall(s) that holds the woofer(s). The enclosure walls and woofer support walls are attached to the speaker base and extend uprightly therefrom.

As stated above, the tweeter is mounted to the enclosure and emits its sound pattern directly outward from the speaker, and the woofer is mounted to the woofer support wall. The woofer, however, emits its low frequency sound pattern directly into the sound channel. From the sound channel, the low frequency sound pattern is reflected off the rear wall of the enclosure and is re-directed out of the speaker. Since the sound channel is symmetrically oriented around the tweeter, the effective low frequency sound pattern (the pattern that actually leaves the speaker) is also symmetrically oriented around the tweeter. Stated differently, the low frequency sound pattern has an effective center axis that is coincident, or co-axial, with the high frequency pattern center axis. This results in improved speaker performance over the entire audible frequency range, even if the listener is not positioned directly in front of the speaker.

BRIEF DESCRIPTION OF THE DRAWINGS

The novel features of this invention will be best understood from the accompanying drawings, taken in conjunction with the accompanying description, in which similar characters refer to similar parts, and in which.

WRITTEN DESCRIPTION OF THE PREFERRED EMBODIMENT

Figure 1A:
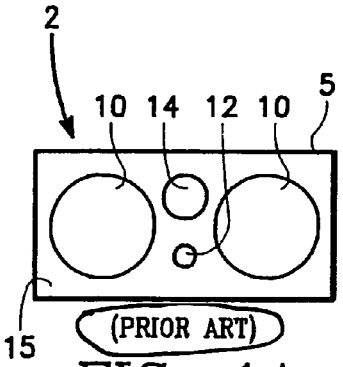
FIGS. 1A–1C are front plan views of common prior art speakers.
Figure 1B:
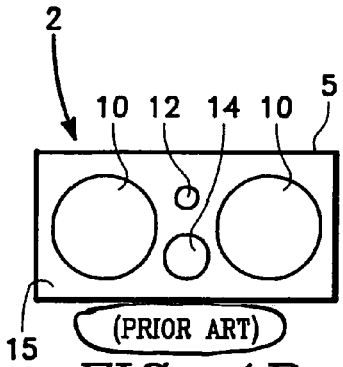

In overview, and referring initially to FIGS. 1A through 2C, prior art speakers are shown and generally designated by reference character 2. Each speaker 2 consists of a casing 5 that houses a pair of low-frequency components 10, or "woofers", that are symmetrically arranged about a mounted mid-range component 14 and a high frequency component 12, or "tweeter". Typically, the mid-range component and the tweeter are positioned in the center of speaker face 15, and the woofers are symmetrically arranged about the tweeter and mid-range component. In some instances, the tweeter and midrange components are co-axially mounted, see FIG. 1C, so that the center axis of the respective sound beams emanating therefrom is coincident, as described more fully below.

Figure 1C:
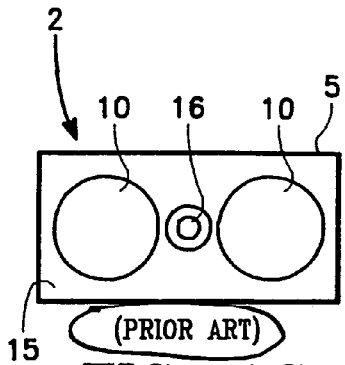
Figure 2A:
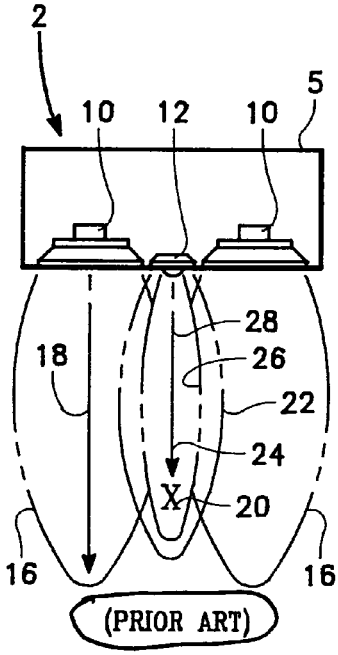
FIGS. 2A–2C are corresponding top plan views of the respective speakers shown in FIGS. 1A–1C, with the top panel of the speaker removed for clarity, and further which schematically demonstrate the manner in which sound beams emanate from the speaker components.
Figure 2B:
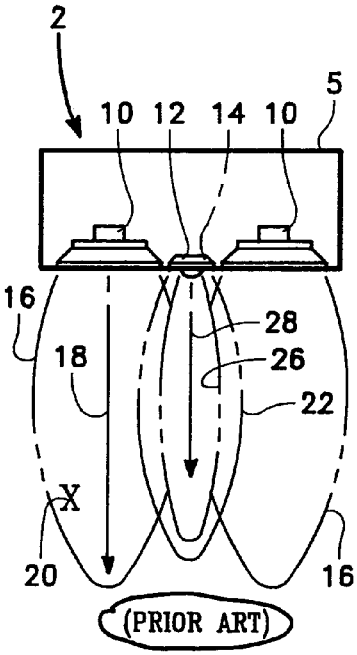
Figure 2C:
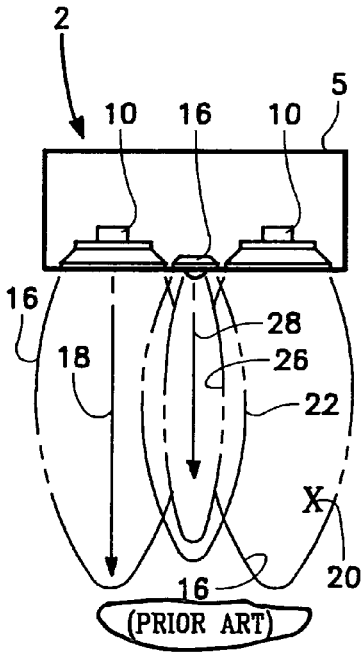

For the above prior art embodiment, and as shown in FIGS. 2A–2C, each woofer has a corresponding sound beam 16 that is centered around a low-frequency center axis 18. Similarly, the mid-range component 14 emits a mid-range sound beam 22 with a mid-frequency center axis 24, and tweeter 12 emits a high-frequency sound beam 26 with a high-frequency center axis 28. For FIGS. 2A and 2B, although mid-frequency center axis 24 and high-frequency 28 appear to be coincident (due to the top plan nature of the Figures) they are actually horizontally displaced. When mid-frequency component 12 and tweeter 14 are co-axial, however, as shown in FIGS. 1C, mid-frequency center axis 24 and high-frequency 28 center axis are coincident, as shown in FIG. 2C. As a result, when listener 20 is in a central position directly in front of the tweeter and mid-range component, the listener receives an equal input from the low-frequency, mid-frequency and high-frequency sound beams. When this occurs, the listener hears all components of the sound pattern equally.

When the listener is positioned off-axis from the center of the speaker, however, and as shown in FIGS. 2B and 2C, the listener 20 is closer to one of the woofer components and receives more of the low frequency sound beams. As a result, the low-frequency component of the sound pattern has more intensity and dominates, and the listener hears too much of the bass component of the music.

Figure 3A:
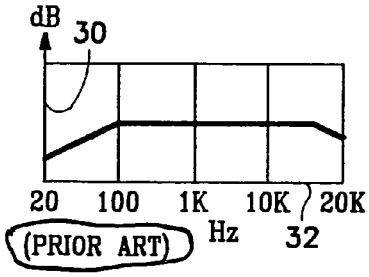
FIGS. 3A–3C are corresponding frequency response graphs according to the location of the listener in respective FIGS. 2A–2C.
Figure 3B:
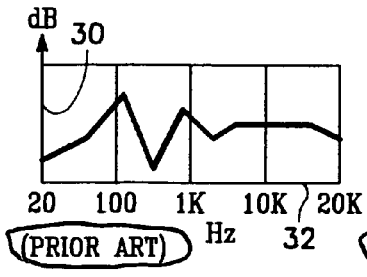
Figure 3C:
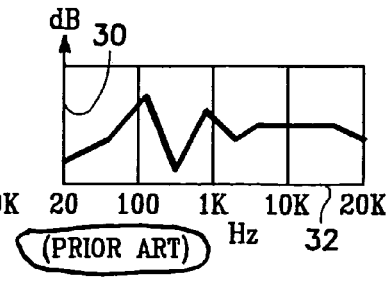

FIGS. 3A–3C are graphical demonstrations of the above-described phenomena. In FIGS. 3A–3C, y-axis 30 quantifies the intensity of sound (in decibels, dB), while x-axis 32 quantifies the audible frequency range, from twenty to twenty thousand Hertz (20–20 KHz). As well known in the prior art, the lower frequency portion of the graph corresponds to the bass component of a sound pattern, while the high frequency portion corresponds to the portion of the sound pattern due to the tweeter.

As shown in FIG. 3A, the frequency response is uniform over the entire range of the audible spectrum when listener 20 is centered relative to prior art speakers (See FIG. 2A). FIGS. 3B and 3C, however, demonstrate a higher intensity "spike" at the low frequency end of the spectrum when the listener 20 is off-axis. This is because more bass sound is received by the listener because the listener does not receive a symmetrical bass input for the reasons described above.

Referring now to FIGS. 4 through 6F, the loudspeaker of the present invention is shown and is generally designated by reference character 40. As shown, the speaker comprises a base 42 and a pair of opposing sidewalls 44*a* and 44*b* that extend upwardly and essentially perpendicularly from the base 42. The sidewalls merge into a rear wall 46 that similarly extends perpendicularly upward from the base.

Figure 4:
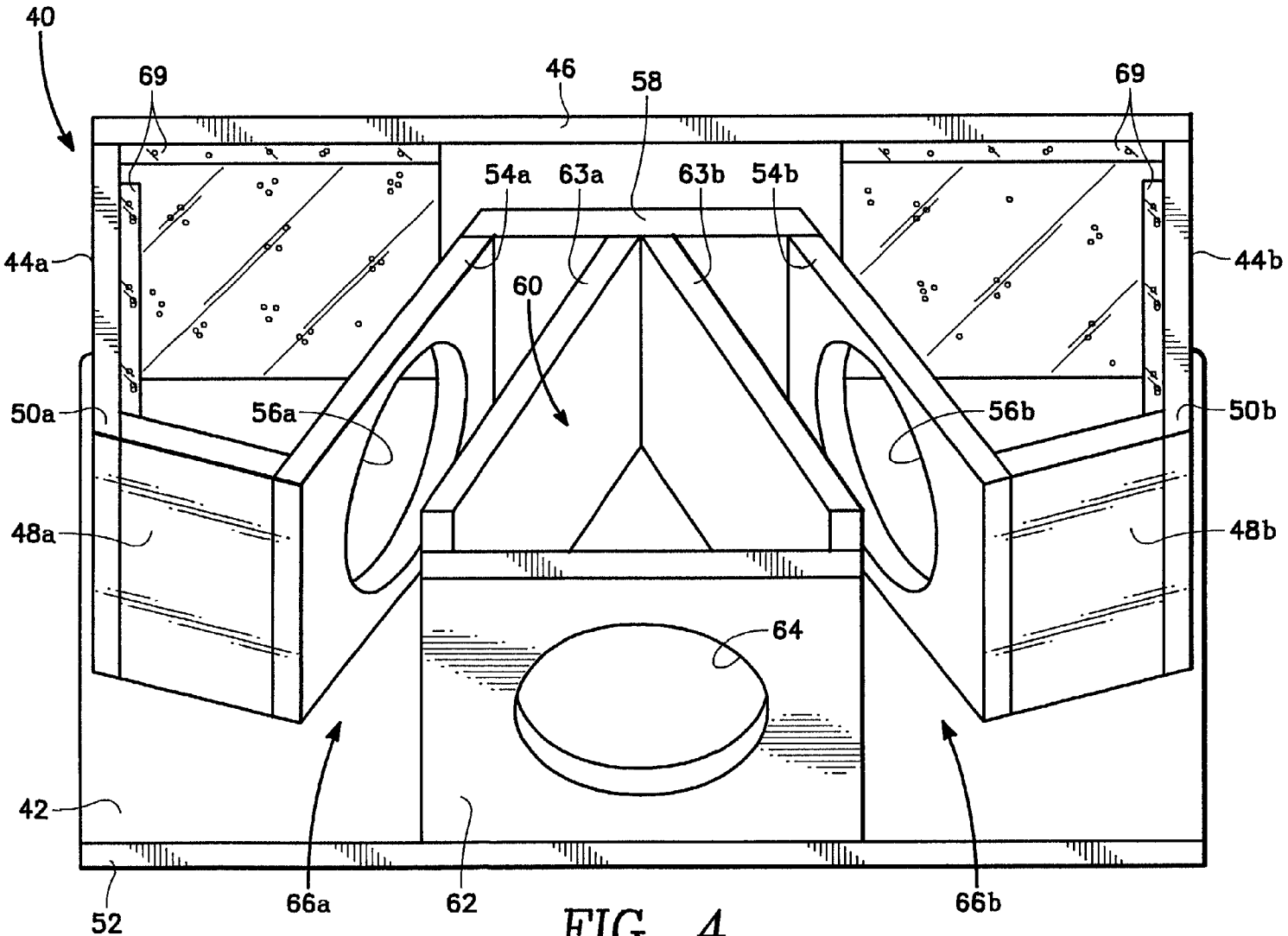
FIG. 4 is a front isometric view of the speaker of the present invention, with the tweeter, woofer and mid-range components removed for clarity.
Figure 5:
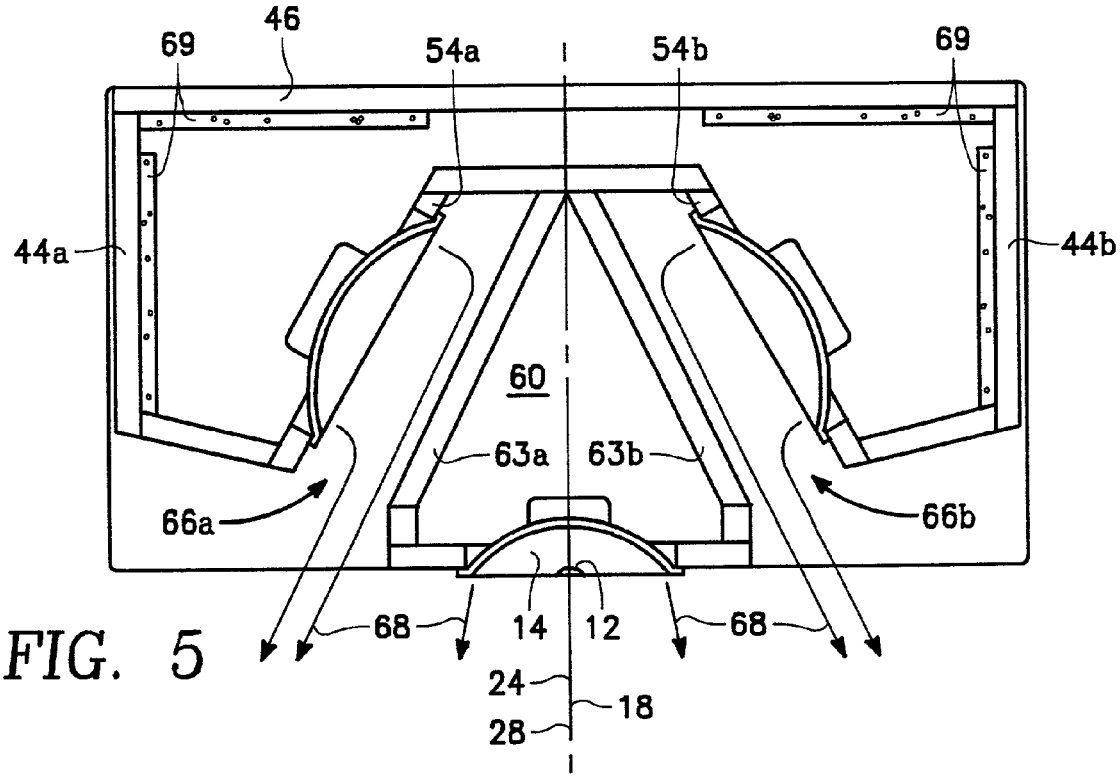
FIG. 5 is a top plan view of the speaker of FIG. 4, but with the tweeter, woofer and mid-range components installed.

A pair of corresponding wall inserts 48*a* and 48*b* are connected to a respective forward edge 50*a*, 50*b* of the opposing sidewalls so that they extend both inwardly from the sidewalls and upright from base 42. As best seen in FIGS. 4 and 5, wall inserts 48*a*, 48*b* are offset somewhat from front edge 52 of base 42.

Wall insert 48*a* interconnects a sidewall 44*a* with a woofer support wall 54*a*. Similarly, wall insert 48*b* interconnects sidewall 44*b* and woofer support wall 54*b*. Each woofer support wall 54 is formed with a woofer opening 56 for mounting the woofer 10 therein in a manner well known in the prior art. A woofer joist 58 interconnects the woofer support walls 54*a*, 54*b* as shown in FIG. 4. As shown in the Figures, woofer joist 58 has a parallel, spaced-apart relationship with rear wall 46.

Forward of woofer joist 58, and as shown in FIGS. 4 and 5, the speaker of the present invention includes an enclosure 60. The front of the enclosure is defined by a tweeter/mid-range support wall 62 which is mounted to the base 42 proximate front edge 52. The tweeter/mid-range support wall extends perpendicularly upward from base 42 in a parallel, spaced-apart relationship with woofer joist 58.

As shown in FIG. 4, tweeter/mid-range support wall 62 includes a circular tweeter/mid-range opening 64 for mounting a coaxial tweeter/mid-range component arrangement. It is to be appreciated, however, that tweeter/mid-range opening could be any geometric shape as required to facilitate mounting of the coaxial arrangement therein. Additionally, it is to be appreciated that tweeter/mid-range support wall 62 could also be formed with separate openings for mounting the tweeter and mid-range components separately without departing from the scope of the present invention.

The remainder of the enclosure is defined by a pair of respective enclosure rear walls 63*a*, 63*b* that are connected the opposing vertical edges of tweeter/mid-range support wall 62. Proceeding rearward from tweeter/mid-range support wall 62, the enclosure rear walls 63*a*, 63*b* extend rearward and towards each other until the rear edges of the rear walls 63*a*, 63*b* are connected to woofer joist 58 so that sidewalls 63*a*, 63*b* just contact each other, as best seen in FIG. 4. This establishes a triangular-shaped tweeter/mid-range enclosure 60 when viewed in top plan, as best seen in FIGS. 4 and 5.

Enclosure rear walls 63*a*, 63*b* are oriented so that they extend perpendicularly upward from base 42. As shown in FIG. 4, each enclosure rear wall 63*a*, 63*b* is also oriented to have a parallel, spaced-apart relationship with a respective woofer support wall 54*a*, 54*b*. The woofer support walls 54*a*, 54*b* cooperate with woofer joist 58 and tweeter sidewalls 60*a*, 60*b* to define a pair of woofer sound channels 66*a*, 66*b*.

As described above, woofer sound channels 66*a*, 66*b* are symmetrically oriented around the tweeter and mid-range components, as shown in FIGS. 4 and 5. This is important because it allows the output from the woofers to be ducted around the output from the mid-range component and the tweeter. More specifically, for each woofer, the low-frequency sound beam from the woofer is emitted directly into enclosure rear wall 63A, 63B. From the rear wall 63A, 63B, the low-frequency sound beam is reflected and re-directed directly through the sound channel and out the front face of the speaker.

Because the sound channel is geometrically symmetrical with respect to the tweeter, and mid-range component, the resulting emitted sound beam from the woofer (as indicated in part by sound arrows 68 in FIG. 5) acts as if it has a low-frequency center axis 18 which is coincident with the mid-range frequency and high-frequency center axes 24, 28 of the respective mid-range component and tweeter sound beams. This is true even though the actual center axes of the low-frequency sound beam, at least initially, is pointed at enclosure rear walls 63*a*, 63*b*.

Stated differently, the overall resulting output of the speaker is one which mimics that of a "tri-axial" speaker, even though the woofer is physically offset from the tweeter and/or mid-range component. This provides for a uniform frequency performance for the speaker over the entire audible spectrum even if the listener 20 is not physically located at the center of the speaker. This configuration further eliminates the attendant power handling and size limitations that would accompany a speaker with a physical tri-axial configuration of woofer, tweeter and mid-range components.

As shown in part in FIGS. 4 and 5, the speaker of the present invention includes a layer of insulation 69 that is attached to the inner surface of sidewalls 44*a*, 44*b* and rear wall 46 as known in the prior art. Insulation could also be attached to the surfaces of tweeter rear walls 63*a*, 63*b*, as well as to woofer supper support walls 54*a*, 54*b*, wall inserts 48*a*, 48*b* or tweeter/mid-range support wall 62 without departing from the scope of the present invention. For the sake of clarity, however, the remaining insulation is omitted from the Figures.

Figure 6A:
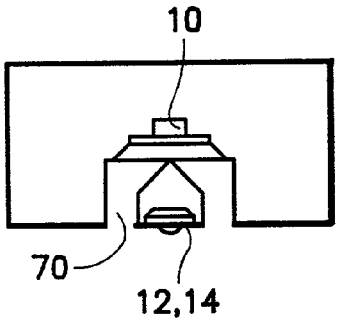
FIG. 6A is a top plan view of an alternative embodiment of the speaker of FIG. 4.
Figure 6B:
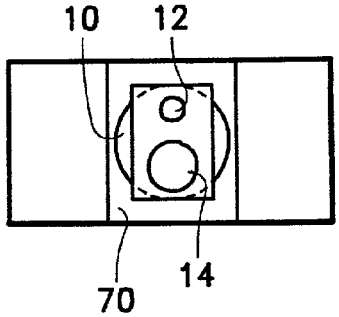
FIG. 6B is a front plan view of the speaker of FIG. 6A.
Figure 6C:
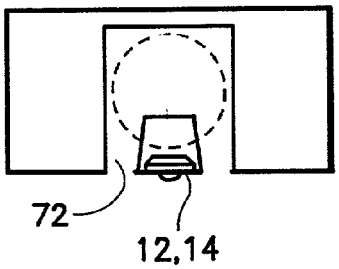
FIG. 6C is a top plan view of a second alternative embodiment of the speaker of FIG. 4.
Figure 6D:
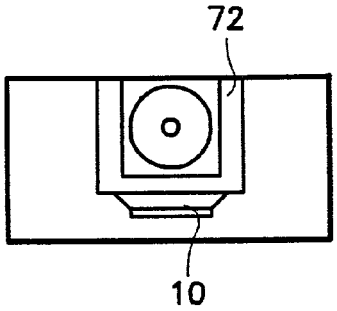
FIG. 6D is a front plan view of the speaker of FIG. 6C.

FIGS. 6A–6F illustrate alternative configurations of the loudspeaker of the present invention. Specifically, FIGS. 6A and 6B illustrate a speaker wherein only one woofer is mounted directly behind the tweeter and mid-range component. The woofer emits sound that travels through first alternative woofer sound channel 70 and out the speaker to achieve the tri-axial effect described above. FIGS. 6C and 6D illustrate a speaker wherein only one woofer is mounted directly below a co-axial tweeter/mid-range component arrangement. The woofer emits sound that travels through second alternative channel 72 and out the speaker to achieve the tri-axial effect described above.

Figure 6E:
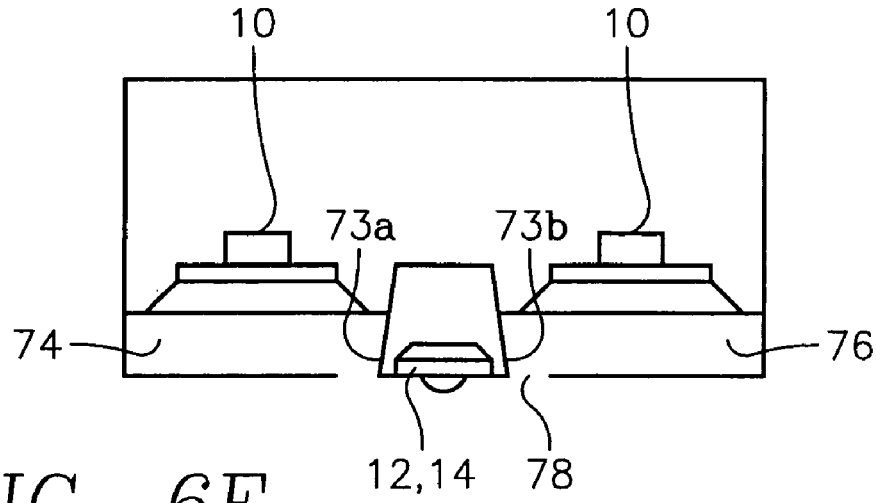
FIG. 6E is a top plan view of a third alternative embodiment of the speaker of FIG. 4.
Figure 6F:
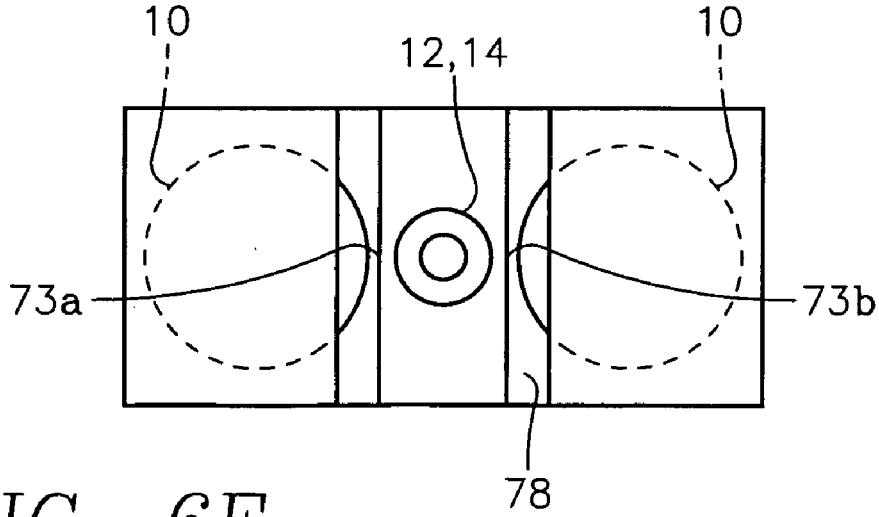
FIG. 6F is a front plan view of the speaker of FIG. 6E.

In FIGS. 6E and 6F, two woofers 10 are mounted on opposing sides, 73*a* and 73*b*, respectively, of a co-axial tweeter/mid-range component arrangement 12, 14. Each woofer emits its low-frequency sound beam component into a respective third alternative sound channel 74. The third alternative sound channel 74 is defined a cavity 76 that is located directly in front of each woofer. The cavity merges into a vertical slot 78 which opens directly out the front of the speaker face in a symmetrical configuration around the tweeter and mid-range component, as shown in FIGS. 6E and 6F. With this configuration, the woofers emit sound that travels through third alternative channel 74 and out the speaker (via the vertical slots 78) to achieve the tri-axial effect described above.

While the stereo speaker, as herein shown and disclosed in detail, is fully capable of obtaining the objects and providing the advantages above stated, it is to be understood that the presently preferred embodiments are merely illustrative of the invention. As such, no limitations are intended other than as defined in the appended claims.

What is claimed is:

1. In a speaker housing having a base with upstanding sidewalls that merge into a rear wall comprising:

a woofer joist upstanding from said base and offset inwardly from said rear wall, said joist having opposing ends and a center portion;

a woofer wall upstanding from said base and diverging from each one of said opposing ends to a woofer wall terminal end;

enclosure walls upstanding from said base and diverging outwardly from said center portion to respective enclosure distal ends; and, a tweeter/mid-range wall upstanding from said base about coextensive with or forward from said woofer wall terminal ends with each tweeter/mid-range wall having respective opposing end portions that interconnect with a corresponding enclosure distal end, each enclosure wall being spaced-apart from a corresponding woofer wall a predetermined distance to form respective woofer sound channels.

2. The housing of claim 1 including a woofer component mounted upon each woofer wall and a tweeter and mid-range component mounted upon said tweeter/mid-range wall.

3. The housing of claim 2 wherein each woofer component is about an equal distance from said tweeter and mid-range component.

4. The housing of claim 3 wherein said woofer sound channels are symmetrically oriented around the tweeter and mid-range component.

5. The housing of claim 2 wherein said tweeter and mid-range component are mounted co-axially.

6. The housing of claim 2 wherein said tweeter and mid-range component are direct radiating sound sources.

7. The housing of claim 2 wherein each one of said woofer joist, woofer walls and enclosure walls have planar inner surfaces.

8. The housing of claim 1 wherein said enclosure walls are parallel to a corresponding woofer wall.

* * * * *